US005173979A

United States Patent [19]

Nennhaus

[11] Patent Number: 5,173,979

[45] Date of Patent: Dec. 29, 1992

[54] INFLATABLE LEG AND FOOT SUPPORTING CUSHION WITH REMOVABLE PADDING

[76] Inventor: H. Peter Nennhaus, 924 Club Cir., Glenview, Ill. 60025

[21] Appl. No.: 871,281

[22] Filed: Apr. 20, 1992

[51] Int. Cl.[5] ..... A47C 20/02; A47G 9/00

[52] U.S. Cl. ..... 5/648; 5/644; 5/645; 5/490

[58] Field of Search ..... 5/648, 644, 650, 651, 5/606, 632, 649, 655, 470, 471, 490, 454, 645; 128/845, 882; 297/DIG. 3; D6/601, 604

[56] References Cited

U.S. PATENT DOCUMENTS

| | | | |
|---|---|---|---|
| D. 278,004 | 3/1985 | Sigona | D6/604 |
| D. 311,470 | 10/1990 | Cosgrove, III et al. | 5/648 |
| 623,548 | 4/1899 | Hurdel . | |
| 1,382,531 | 6/1921 | Newborn | 5/644 |
| 1,382,831 | 6/1921 | Hilker | 5/644 |
| 2,351,849 | 6/1944 | Wells et al. | 5/633 |
| 3,308,489 | 3/1967 | Winkler | 5/648 |
| 3,333,286 | 8/1967 | Biolik | 5/648 |
| 3,644,949 | 2/1972 | Diamond | 5/648 |
| 4,389,742 | 6/1983 | DeWitt | 5/455 |
| 4,724,560 | 2/1988 | Christie | 5/451 |
| 4,901,385 | 2/1990 | Adolphson | 5/648 |
| 4,932,089 | 6/1990 | Laviero | 5/644 |
| 5,044,030 | 9/1991 | Balaton | 5/455 |
| 5,097,553 | 3/1992 | Boland | 5/648 |
| 5,113,875 | 5/1992 | Bennett | 5/648 |

FOREIGN PATENT DOCUMENTS

| | | | |
|---|---|---|---|
| 1544119 | 10/1968 | France | 5/648 |

*Primary Examiner*—Alexander Grosz
*Attorney, Agent, or Firm*—Dick and Harris

[57] ABSTRACT

An inflatable cushion apparatus for maintaining a person's lower leg, ankle and foot, in an elevated and substantially horizontal position relative to the person's head and upper body. The inflatable cushion apparatus includes an angled front wall for supporting a person's upper leg in an inclined position. A top wall is provided which extends horizontally when the apparatus is inflated. A valve is provided to facilitate filling of the cushion apparatus.

11 Claims, 2 Drawing Sheets

INFLATABLE LEG AND FOOT SUPPORTING CUSHION WITH REMOVABLE PADDING

BACKGROUND OF THE INVENTION

The present invention is directed to inflatable cushion apparatus, particularly those configured for therapeutic use as support for a patient's legs in the treatment of leg ulcers and related disorders.

Hundreds of thousands of people suffer from inadequate circulation in the lower legs which prompts the development of swelling and/or open sores or ulcers. Treatment of such ailments has developed into three categories: elevation; compressive stockings or bandaging: and medicinal or cleansing salves. It has been determined, however, that elevation is a far more efficient, simple and economical method of treatment of such ailments.

Mere elevation is insufficient, though, since the manner in which the elevation is accomplished determines whether the treatment will be effective. If done improperly, elevation can cause complications or simply be ineffective. Most patients, even in hospitals, receive leg elevation treatment which is either therapeutically ineffective or anatomically uncomfortable or both, such as elevation of only the foot or simultaneous, inappropriate elevation of the upper body. Appropriate treatment consists of raising the lower legs to a level above the upper body, with the lower legs extending horizontally. The upper legs should be raised at an incline. Such positioning promotes draining of excess fluids from the swollen areas. It is accordingly desirable to provide a leg support which is simple to construct and use, which immediately places a patient into the proper treatment position.

Previous leg support constructions typically consisted of a simple wedge, covered by fabric or other material and filled with foamed rubber, batting or the like. Such supports tended to absorb fluids and, over time, became matted, lost resilience, or permanently deformed. It is therefore further desirable to provide a support which is moisture-proof, resilient, and resistant to wear, tear and fatigue.

It is known in the prior art to provide a foot or leg support, such as a hassock, with an inflatable construction. An example of such construction is Hurdel. U.S. Pat. No. 623,548. In Hurdel '548, a substantially box-shaped inflatable envelope construction is provided. Other inflatable or fluid-filled cushions or supports may be found in Hilker, U.S. Pat. No. 1,382,831; and Sigona, U.S. Pat. No. Des. 278,004. However, such prior art supports do not provide an inclined portion which provides for the support of a patient's upper legs or thighs in an inclined position, while maintaining the upper body in a substantially flat horizontal position with the lower leg, ankle and foot in a similar horizontal position but raised relative to the patient's upper body.

Accordingly, it is an object of the present invention to provide a cushion or support apparatus which is configured to provide for the appropriate positioning of a patient's legs, for the treatment of leg ulcers and related disorders. It is a further object of the invention to provide a cushion which places a patient's lower legs in a horizontal elevated position, with the upper legs at an inclined position, while permitting the patient to maintain his upper body in a horizontal, lowered position, thus achieving a 6 to 8 inch elevation of the lower leg above the level of the person's heart.

Another object of the invention is to provide such a support or inflatable cushion apparatus, which is inflatable. Still another object of the present invention is to provide an inflatable cushion apparatus which is simply constructed and simple to use. Still another object of the invention is to provide a therapeutic leg supporter inflatable cushion apparatus, which is fabricated from water-resistant and wear resistant materials so as to be moisture-proof, resilient and resistant to permanent deformation.

Yet another object of the invention is to provide a therapeutic leg support apparatus which is provided with upper surfaces which are transiently deformable so as to conform slightly to the contours of a patient's leg surfaces for facilitated comfort in use.

These and other objects of the invention will become apparent in light of the present specification, claims and drawings.

SUMMARY OF THE INVENTION

The present invention is directed to therapeutic cushion apparatus, and in particular to an inflatable cushion apparatus for supporting and maintaining a person's lower leg, ankle and foot, in an elevated and substantially horizontal position relative to the person's head and upper body, and for supporting the person's upper leg in an inclined position. The inflatable cushion apparatus is formed as an envelope portion, fabricated from substantially fluid-impermeable material, and includes a plurality of walls, operably assembled so as to be able to enclose and maintain a volume of air therewithin, such that the envelope portion, when so inflated, is capable of supporting loads placed on it.

In particular, the inflatable cushion apparatus comprises a substantially rectangular bottom wall, having a leading edge and a rear edge. A top wall is operably disposed to extend substantially parallel to the bottom wall when the envelope portion is filled with air, and also has a leading edge and a rear edge. A back wall is operably disposed to extend from the rear edge of the bottom wall to the rear edge of the top wall. A front wall extends from the leading edge of the bottom wall upward, at an incline, to the leading edge of the top wall, the front and bottom walls thereby defining an acute included angle therebetween.

First and second side walls, connect the top, bottom, rear and front walls. Valve means, operably disposed in one of the walls, are operably openable and closable so as to enable the envelope portion to be filled when the valve is opened, and to retain its contents when the valve is closed.

In an alternative preferred embodiment of the invention, a horizontal partition consisting of the same fluid-impermeable material, is operably disposed within the envelope portion in a manner so as to divide it into upper and lower chambers where the height of the upper chamber is equal to or less than the height of the lower chamber. Through an appropriate closable opening, the upper chamber is filled with a non-gaseous fluid such that when the person's leg is placed upon the cushion apparatus, the non-gaseous fluid flows to enable the top surface to partially conform to and cradle the person's lower leg. The non-gaseous fluid may be water, or a gel.

In a preferred embodiment of the invention, a retaining lip member, operably disposed along the leading edge of the bottom wall, collects and retains fluid, which may escape from a draining ulcer.

At least one padding member may be provided that is attachable to and removable from at least the top wall or top surface either for providing further cushioning of the person's leg, or, in the nature of disposable diapers, for the absorption of wound drainage. In an embodiment of the invention, the padding member may be attached with hook and loop type fasteners, while in alternative embodiments, corresponding buttons and buttonholes, or male and female snap members may be used.

A removable cover member may be provided which is configured to insertingly receive the envelope portion.

DETAILED DESCRIPTION OF THE DRAWINGS

Figure 2:
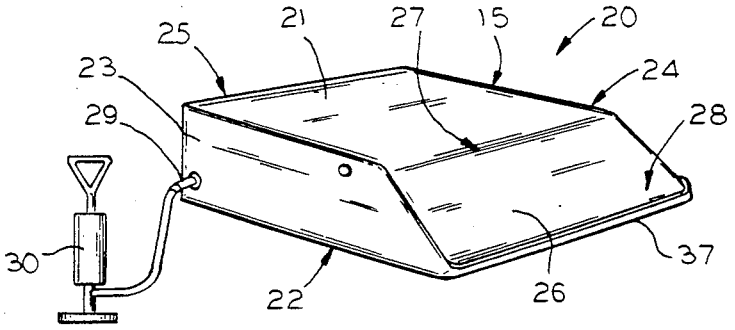
FIG. 2 is a front perspective view of the inflatable cushion apparatus, shown with an inflating means.

While this invention is susceptible of embodiment in many different forms, there is shown in the drawings and will herein be described in detail, particular embodiments, with the understanding that the present disclosure is to be considered as an exemplification of the principles of the invention and is not intended to limit the invention to the embodiments illustrated.

The present invention is directed to an apparatus for promoting the correct treatment of leg disorders, such as leg ulcers, swelling and the like. Such illnesses affect hundreds of thousands of persons, and are typically the result of abnormal circulatory congestion of the legs.

While various forms of salves or bandaging techniques have been developed, it has been determined that elevation of the afflicted limbs is at least as effective a method of treatment, and is far more economical. However, the manner in which the elevation is performed is crucial.

The critical elements which are necessary to proper elevation for effective treatment of such described leg disorders are: 1) the lower leg must be horizontal, and positioned above the patient's upper body; 2) the patient's upper legs should be supported at an incline in order to promote draining of fluid from the lower legs and to otherwise promote the reduction of swelling and improved circulation; and 3) the patient's upper body should be substantially horizontal in a manner that places the lower leg 6 to 8 inches above the level of the heart.

Figure 1:
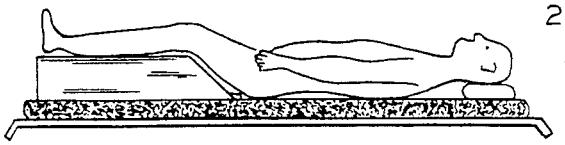
FIG. 1 is a schematic view of a patient in the appropriate treatment position, in a home environment utilizing the present invention.
Figure 3:
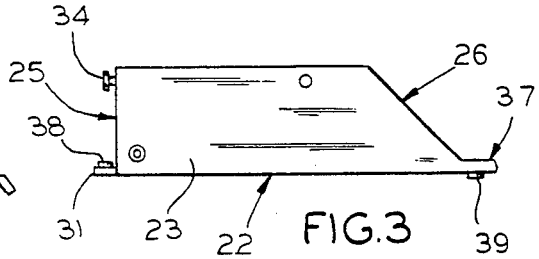
FIG. 3 is a side elevation of the invention according to FIG. 2, showing the fluid catching lip, the valve, and the closure means.

FIG. 1 depicts a patient, utilizing the inflatable cushion apparatus of the present invention in combination with a common bed (a sofa, or other flat cushioning support surface will also work as well).

FIGS. 2-8 show the inflatable cushion apparatus according to the preferred embodiment of the present invention.

In addition to not having the desired appropriate configuration, it has been observed that previous therapeutic cushions tended to be constructed more like mere upholstered structures of fabric, and foamed rubber or similar filler material. Such cushions will become soiled, difficult to return to a hygienically clean state, and will also permanently deform over time. In addition, such previous cushions are bulky and awkward to handle or store when not in use.

The inflatable cushion apparatus 20, as shown in FIGS. 2-8, according to the present invention, however, is constructed as an envelope 15, of airtight configuration, which may be inflated. Having a simple, straightforward construction, inflatable cushion apparatus 20 includes top wall 21, bottom wall 22, side walls 23 and 24, and back wall 25. Bottom wall 22, while configured to be parallel to top wall 21, upon inflation of inflatable cushion apparatus 20, extends forward beyond top wall 21, such that front wall 26 inclines backwardly up toward front edge area 27 of top wall 21. It has been determined that the included angle which front wall 26 makes with bottom wall 22, should be about 45 degrees, for optimum treatment effectiveness and patient comfort.

The lower leading edge area 28 of front wall 26 is provided with an upwardly-concave lip 37 for the entrapment and retention of fluid from the elevated leg portions, toward maintaining the patient's bed, sofa or the like clean.

As will be described hereinafter, closure tab 31 emanates from envelope 15 along the center of the edge where back wall 25 meets bottom wall 22. Closure tab 31, in the preferred embodiment has one element 38 of a hook-and-loop fastener material affixed to its upper side. A complementary part 39 of a hook-and-loop fastener material is affixed to bottom wall 22, in the region beneath lip 37. Aside from hook-and-loop type fasteners, snap fasteners or a simple button and button hole might be used instead.

In the preferred embodiment of the invention, inflatable cushion apparatus 20 is fabricated from envelope 15, composed of air-tight, waterproof material, such as vinyl. Valve 29, which may be of known construction, is provided to permit inflation and deflation of the envelope. Inflation may be accomplished by blowing, or by a manually- or electrically-operated pump 30.

Since top wall 21 may be somewhat unyielding, when inflatable cushion apparatus 20 is inflated, it may give rise to pressure sores or to discomfort in cases with compromised circulation. In addition, the vinyl or plastic material may be somewhat slippery, so that the patient's leg might tend to slide off, each time the patient shifts his/her position slightly. Accordingly, optional cushion 32 may be provided, and may be attached to the envelope by buttons 34. Cushion 32 may be configured as a simple thin fiber- or foam-filled pillow, or may be a more sophisticated cushion, like a "gel pad", which is filled with a viscous gel which flows to form a pocket conforming to the patient's leg contours. In the alternative, cushion 32 may be a disposable and replaceable, diaper-like absorbent pad for the entrapment of wound drainage. Cushion 32 may be attached with buttons, snaps or hook-and-loop type fasteners.

Figure 4:
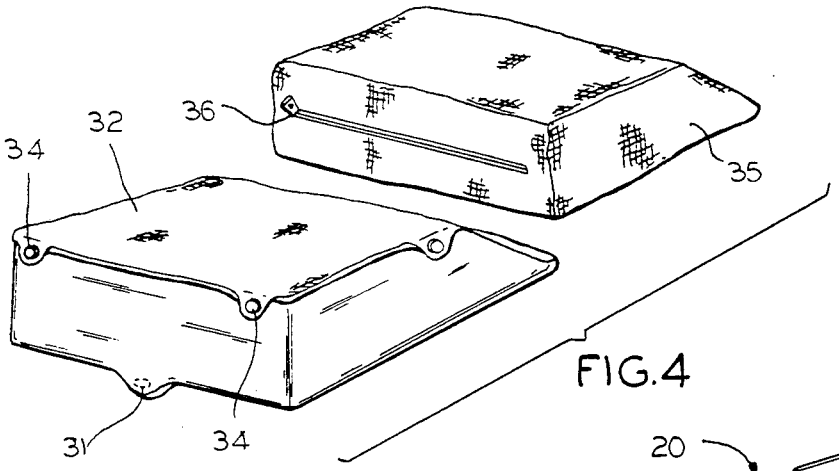
FIG. 4 is a rear perspective view of the invention according to FIG. 2, showing the optional upper surface cushion, and optional slipcover.
Figure 5:
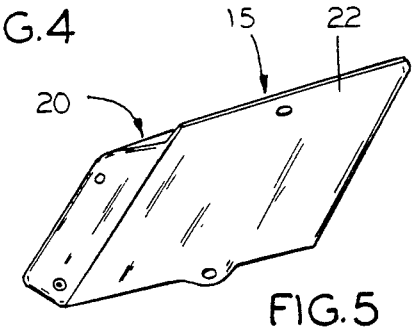
FIG. 5 is a below-angle perspective view of the inflatable cushion apparatus.
Figure 6:
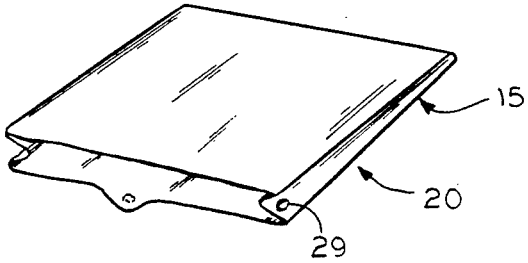
FIG. 6 is an above-angle perspective view of the invention according to FIG. 5, in a substantially deflated configuration.

In addition to an optional upper surface cushion, the present invention may also be provided with an overall slipcover, such as cover 35, as shown in FIG. 4. Cover 35, which may typically be configured from a decorative fabric material, provides an improved esthetic appearance to inflatable cushion apparatus 20. A closure means, such as zipper 36, enables cover 35 to be removed, as necessary, for cleaning or replacement.

Figure 7:
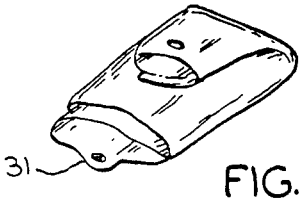
FIG. 7 is an above-angle perspective view of the invention according to FIG. 5, showing the inflatable cushion in substantially folded configuration.
Figure 8:
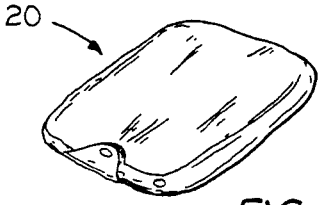
FIG. 8 is an above-angle perspective view of the inflatable cushion apparatus in completely folded and closed configuration.

A principal advantage of the inflatable cushion apparatus of the present invention is that it is collapsible, upon deflation, into a compact package, for transportation and storage. FIGS. 5–8 depict how, in a preferred embodiment of the invention, such collapsibility may be accomplished. Cushion apparatus 20, being fabricated as envelope 15, is deflated upon opening of valve 29. Side walls 23 and 24 ar folded inward to permit top wall 21 and bottom wall 22 to be brought together in overlying relationship (see FIG. 6). Flattened envelope 15 is then folded lengthwise into thirds, with the edges being folded toward the center. The "front" end of the folded envelope is then further folded over, toward the "back" end, as shown in FIG. 7, so that the mated hook-and-loop fastener portions both face upwardly. Closure tab 31 is then folded over to bring the two fastener portions into alignment, to complete the closure, as shown in FIG. 8. While such hook-and-loop type fasteners may be used, it is also possible to employ a male-female snap-type fastener, or a simple button and buttonhole arrangement.

Figure 9:
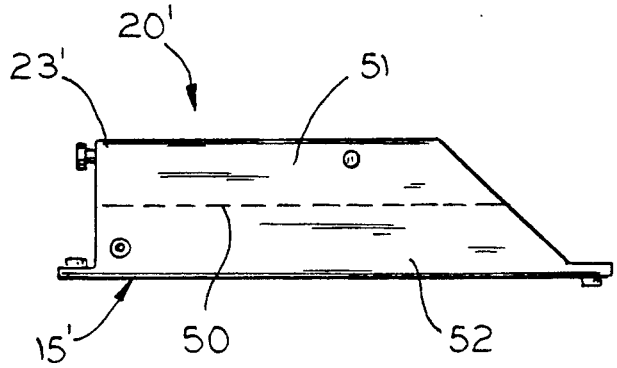
FIG. 9 is a side elevation of the inflatable cushion apparatus according to an alternative preferred embodiment having an interior partition.
Figure 10:
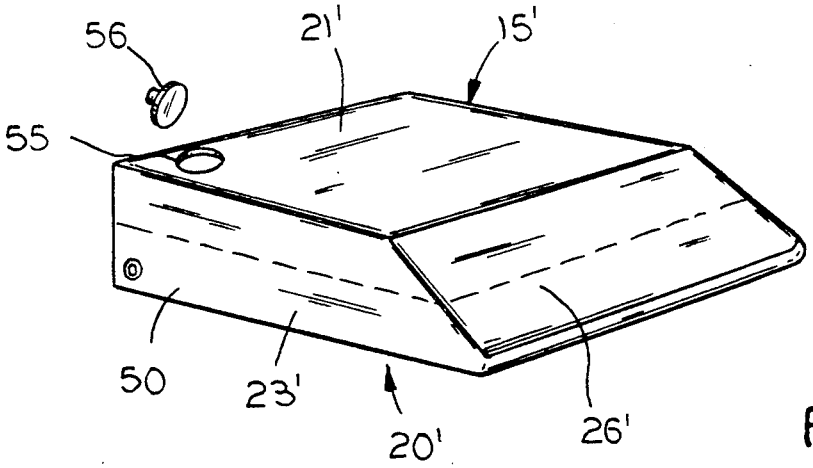
FIG. 10 is a top perspective view of the inflatable cushion apparatus according to FIG. 9.

As an alternative embodiment, it may be desirable to construct inflatable cushion apparatus 20' to have a fluid filled upper chamber, as shown in FIGS. 9 and 10. This is achieved by means of horizontal partition 50, made of the same fluid-impermeable material as the remainder of envelope 15', which is the same material as envelope 15 of the previously described embodiment. Partition 50 is indicated by the dashed line, where it meets side wall 23' and front wall 26'. Partition 50 is operably disposed within envelope 15' in a manner so as to divide the cushion apparatus into upper chamber 51 and lower chamber 52. In a preferred embodiment of the invention, the height of the upper chamber is equal to (as shown in FIGS. 9 and 10), or less than the height of the lower chamber. Through a closable opening in top wall 21', such as opening 55, closable by plug 56, upper chamber 51 can be filled with a non-gaseous fluid so that when the person's leg is placed upon cushion apparatus 20', the fluid would yield to the weight of the leg and allow the top wall 21' to conform to the contour of the leg.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. An inflatable cushion apparatus for supporting and maintaining a person's lower leg, ankle and foot, in an elevated and substantially horizontal position relative to said person's head and upper body and for supporting said person's upper leg in an inclined position, said inflatable cushion apparatus being formed as an envelope portion, fabricated from substantially fluid-impermeable material, said envelope portion including a plurality of walls, operable assembled so as to be able to enclose and maintain a volume of fluid therewithin, such that said envelope portion, when so filled with fluid, is capable of supporting loads placed thereon, said inflatable cushion apparatus comprising:

a substantially rectangular bottom wall, having a leading edge and a rear edge;

a top wall, operable disposed to extend substantially parallel to said bottom wall when said envelope portion is inflated, and having a leading edge and a rear edge;

a back wall, operably disposed to extend from said rear edge of said bottom wall to said rear edge of said top wall;

a front wall, operably disposed to extend from said leading edge of said bottom wall upwardly, at an incline, to said leading edge of said top wall, said front and bottom walls thereby defining an acute included angle therebetween;

first and second side walls, operably disposed to connect said top, bottom, rear and front walls;

valve means, operably disposed in one of said walls, said valve means being operably openable and closable so as to enable said envelope portion to be filled when said valve is opened, and to retain its contents when said valve is closed;

horizontal partition means operably disposed within said envelope portion so as to divide said envelope portion into at least an upper and lower chamber, said valve means comprising separate fluid filling means for each of said upper and lower chambers;

at least one padding member operably attachable to and removable from at least said top wall for providing further cushioning of said person's leg; and cooperating fastener means on each of said envelope portion and said at least one padding member, for removably attaching said at least one padding member to said top wall of said envelope portion.

2. The inflatable cushion apparatus according to claim 1 in which the invention further comprises:

said upper chamber having a height equal to or less than that of said lower chamber;

said upper chamber substantially fillable with a non-gaseous fluid, so that when said person's lower leg is placed on said cushion apparatus, said non-gaseous fluid flows to enable said top surface to at least partially conform to said person's lower leg.

3. The inflatable cushion apparatus according to claim 1, further comprising:

a retaining lip member operable disposed along said leading edge of said bottom wall for collecting and retaining fluid.

4. The inflatable cushion apparatus according to claim 1 in which said at least one padding member comprises an absorbent padding member operably attachable to and removable from at least said top wall for providing absorption of drainage from said person's lower leg.

5. The inflatable cushion apparatus according to claim 1 wherein said cooperating fastener means for removably attaching said at least one padding member comprises:

buttons operably affixed proximate to said top wall of said envelope portion; and buttonholes operably disposed in said at least one padding member for engagement with corresponding ones of said buttons.

6. The inflatable cushion apparatus according to claim 1 wherein said cooperating fastener means for removably attaching said at least one padding member comprises:

at least one corresponding pair of mated hook-and-loop fastener members, at least one of said fastener members operably arranged on said envelope portion and configured to cooperate with at least another of said fastener members arranged on said at least one padding member.

7. The inflatable cushion apparatus according to claim 1, further comprising:

air pumping means, operably connectable to said valve means, for facilitated inflation of said envelope portion.

8. The inflatable cushion apparatus according to claim 1, wherein said fluid filling said upper chamber comprises:

a liquid, such as water.

9. The inflatable cushion apparatus according to claim 1, wherein said fluid filling said upper chamber comprises:

a gel.

10. The inflatable cushion apparatus according to claim 1 wherein said front wall and said bottom wall define an included angle therebetween of 45 degrees or less.

11. The inflatable cushion apparatus according to claim 1 wherein said at least one padding member comprises a removable cover member configured to insertingly receive said envelope portion.

* * * * *

UNITED STATES PATENT AND TRADEMARK OFFICE

CERTIFICATE OF CORRECTION

PATENT NO. : 5,173,979

DATED : December 29, 1992

INVENTOR(S) : H. Peter Nennhaus

It is certified that error appears in the above-indentified patent and that said Letters Patent is hereby corrected as shown below:

Column 1 line 48, after "Hurdel", delete "." and insert --,--.

Column 4, line 19, after "fabric", delete ",".

Column 6, line 9, delete "operable" and insert --operably--.
line 16, delete "operable" and insert --operably--.
line 58, delete "operable" and insert --operably--.

Signed and Sealed this

Nineteenth Day of April, 1994

Bruce Lehman

BRUCE LEHMAN

*Commissioner of Patents and Trademarks*

*Attest:*

*Attesting Officer*